US012808558B2

(12) United States Patent
Ishida et al.

(10) Patent No.: US 12,808,558 B2
(45) Date of Patent: Nov. 24, 2026

(54) VENTILATION AMOUNT ESTIMATION DEVICE, VENTILATION AMOUNT ESTIMATION METHOD, AND PROGRAM

(71) Applicant: DAIKIN INDUSTRIES, LTD., Osaka (JP)

(72) Inventors: Ayane Ishida, Osaka (JP); Yufeng Wang, Osaka (JP); Takehiko Hiei, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 327 days.

(21) Appl. No.: 18/606,661

(22) Filed: Mar. 15, 2024

(65) Prior Publication Data

US 2024/0263816 A1 Aug. 8, 2024

Related U.S. Application Data

(63) Continuation of application No. PCT/JP2022/026517, filed on Jul. 1, 2022.

(30) Foreign Application Priority Data

Sep. 29, 2021 (JP) ..... 2021-159795

(51) Int. Cl.
*F24F 11/00* (2018.01)
*F24F 11/63* (2018.01)
(Continued)

(52) U.S. Cl.
CPC ..... *F24F 11/0001* (2013.01); *F24F 11/63* (2018.01); *F24F 2110/70* (2018.01); *F24F 2120/10* (2018.01)

(58) Field of Classification Search
None
See application file for complete search history.

(56) References Cited

U.S. PATENT DOCUMENTS

2018/0088544 A1 3/2018 Sawada et al.
2018/0128511 A1* 5/2018 Motodani ..... F24F 11/89

FOREIGN PATENT DOCUMENTS

JP 11-14590 A 1/1999
JP 2010-19484 A 1/2010
(Continued)

OTHER PUBLICATIONS

International Search Report of corresponding PCT Application No. PCT/JP2022/026517 dated Sep. 20, 2022.
(Continued)

*Primary Examiner* — Ryan A Jarrett
(74) *Attorney, Agent, or Firm* — Spencer Fane LLP

(57) ABSTRACT

A ventilation amount estimation device estimates a ventilation amount of an indoor target space. The ventilation amount estimation device includes a control unit configured to output, based on a value related to an actual measurement value of a carbon dioxide concentration in the target space and a plurality of calculation results related to a carbon dioxide concentration in the target space calculated with a condition changed, an estimated value of the ventilation amount of the target space from a calculation result corresponding to the actual measurement value of the plurality of calculation results.

14 Claims, 13 Drawing Sheets

(51) Int. Cl.
*F24F 110/70* (2018.01)
*F24F 120/10* (2018.01)

(56) References Cited

FOREIGN PATENT DOCUMENTS

| | | | |
|---|---|---|---|
| JP | 2013-185768 | A | 9/2013 |
| JP | 2020-148374 | A | 9/2020 |
| WO | 2016/185630 | A1 | 11/2016 |

OTHER PUBLICATIONS

International Preliminary Report of corresponding PCT Application No. PCT/JP2022/026517 dated Apr. 11, 2024.

* cited by examiner

| DECREASE SECTION | CANDIDATE VENTILATION AMOUNT Q | NUMBER N OF REMAINING PEOPLE | ERROR |
|---|---|---|---|
| 1 | 650 | 2 | 7.642 |
| 2 | 450 | 0 | 11.519 |
| 3 | 550 | 0 | 1.197 |
| 4 | 750 | 1 | 2.258 |
| 5 | 450 | 0 | 12.945 |

FIG.10

W

| ANDIDATE VENTILATION AMOUNT R | SECOND CONCENTRATION DIFFERENCE ΔC2 |
|---|---|
| $50m^3/h$ | 20ppm(ΔCmin) |
| ⋮ | ⋮ |
| $100m^3/h$ | 40ppm |
| $120m^3/h$ | 50ppm |
| $140m^3/h$ | 60ppm(ΔC2a) |
| ⋮ | ⋮ |
| $200m^3/h$ | 80ppm(ΔCmax) |

VENTILATION AMOUNT ESTIMATION DEVICE, VENTILATION AMOUNT ESTIMATION METHOD, AND PROGRAM

CROSS-REFERENCE TO RELATED APPLICATIONS

This is a continuation of International Application No. PCT/JP2022/026517 filed on Jul. 1, 2022, which claims priority to Japanese Patent Application No. 2021-159795, filed on Sep. 29, 2021. The entire disclosures of these applications are incorporated by reference herein.

BACKGROUND

Technical Field

The present disclosure relates to a ventilation amount estimation device, a ventilation amount estimation method, and a program.

Background Art

A ventilation amount estimation device disclosed in Japanese Unexamined Patent Publication No. 2010-19484 includes carbon dioxide concentration measurement means installed in a predetermined closed space and configured to measure a predetermined carbon dioxide concentration; and arithmetic processing means configured to calculate a ventilation amount in the closed space by inputting, as concentrations at a first time point and a second time point before the first time point, predetermined carbon dioxide concentrations measured at two different time points by the carbon dioxide concentration measurement means in a time period in which a predetermined carbon dioxide generation amount is known into a relational expression in which a carbon dioxide concentration in the closed space at the first time point is expressed based on influence of a carbon dioxide concentration at the second time point and influence of generation of carbon dioxide in the closed space in consideration of the ventilation amount estimation device in the closed space.

SUMMARY

A first aspect of the present disclosure is directed to a ventilation amount estimation device for estimating a ventilation amount of an indoor target space. The ventilation amount estimation device includes a control unit configured to output, based on a value related to an actual measurement value of a carbon dioxide concentration in the target space and a plurality of calculation results related to a carbon dioxide concentration in the target space calculated with condition changed, an estimated value of the ventilation amount of the target space from a calculation result corresponding to the actual measurement value among the plurality of calculation results.

BRIEF DESCRIPTION OF THE DRAWINGS

FIG. 10 is a table showing correspondence information.

DETAILED DESCRIPTION OF EMBODIMENT(S)

Figure 1:
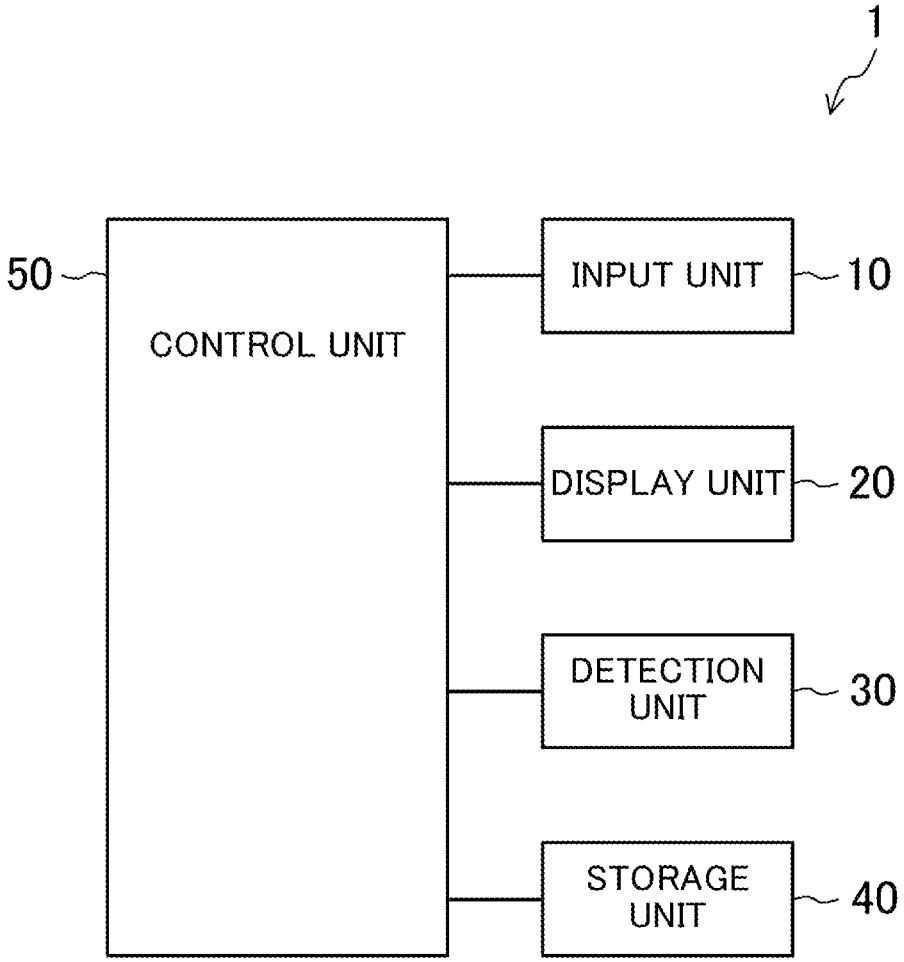
FIG. 1 is a block diagram showing the configuration of a ventilation amount estimation device according to an embodiment of the present invention.

Embodiments of the present invention will be described in detail with reference to the drawings. Note that like reference characters denote the same or equivalent components in the drawings, and the detailed description thereof, the description of advantages associated therewith, and other descriptions will not be repeated.

First Embodiment

A first embodiment of a configuration for estimating a ventilation amount of a target space which is an indoor space will be described. A ventilation amount estimation device (1) according to an embodiment of the present invention will be described with reference to FIG. 1. FIG. 1 is a block diagram showing the configuration of the ventilation amount estimation device (1) according to the embodiment of the present invention. The ventilation amount estimation device (1) includes a personal computer (PC). The ventilation amount estimation device (1) estimates the ventilation amount of the target space which is the indoor space.

General Configuration

As shown in FIG. 1, the ventilation amount estimation device (1) includes an input unit (10), a display unit (20), a detection unit (30), a storage unit (40), and a control unit (50).

The input unit (10) receives an instruction for the ventilation amount estimation device (1) from the outside. The input unit (10) includes, for example, a keyboard or a touch panel.

The display unit (20) displays information such as the ventilation amount of the target space estimated by the ventilation amount estimation device (1). The display unit (20) includes, for example, a liquid crystal display (LCD) or an electro luminescence display (ELD).

The detection unit (30) is a sensor that detects a concentration of carbon dioxide in the target space.

The storage unit (40) includes a main memory (e.g., semiconductor memory) such as a flash memory, a read only memory (ROM), and a random access memory (RAM), and may further include an auxiliary memory (e.g., hard disk drive, solid state drive (SSD), secure digital (SD) memory card, or universal serial bus (USB) flash memory). The storage unit (40) stores various computer programs executable by the control unit (50).

The control unit (50) includes a processor such as a CPU and an MPU. The control unit (50) executes a computer program stored in the storage unit (40) to control each element of the ventilation amount estimation device (1).

Operation of Control Unit of First Embodiment

Operation of the control unit (50) of the first embodiment will be described with reference to FIGS. 1 to 6.

Figure 2:
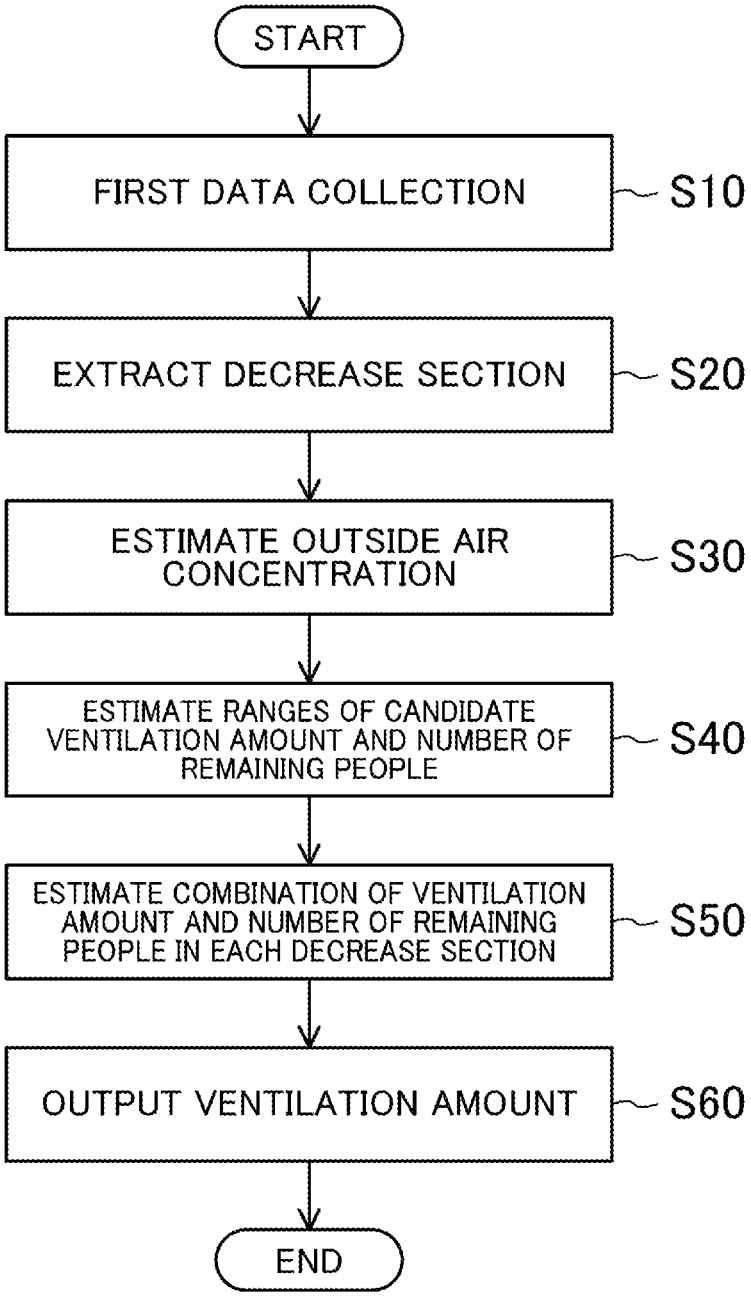
FIG. 2 is a flowchart showing operation of a control unit of the first embodiment.
Figure 3:
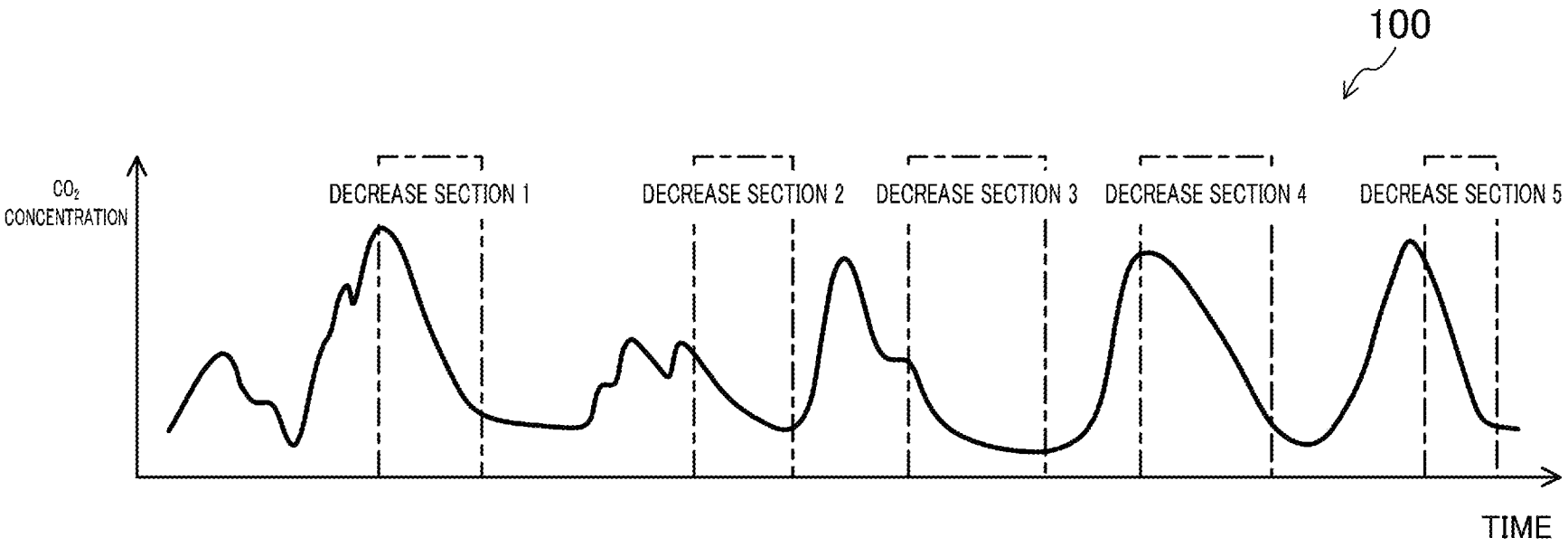
FIG. 3 is a graph showing concentration information collected by first data collection processing.

As shown in FIGS. 1 and 2, in Step S10, the control unit (50) performs first data collection processing. The first data collection processing is processing of the control unit (50) collecting, for a predetermined period (e.g., one week), first concentration information (100) indicating an actual measurement value of the carbon dioxide concentration detected in the target space by the detection unit (30). FIG. 3 shows the first concentration information (100) collected by the first data collection processing. The first concentration information (100) is information on an association between the carbon dioxide concentration detected in the target space by the detection unit (30) and the time of detection of the carbon dioxide concentration. The first concentration information (100) indicates the actual measurement value of the carbon dioxide concentration in the target space, which is output over time.

As shown in FIGS. 1 to 3, in Step S20, the control unit (50) extracts a decrease section from the first concentration information (100). The decrease section is a section in which the carbon dioxide concentration decreases over time. When there is a stable portion in which the concentration does not change greatly after decrease, the stable portion is also included in the decrease section. As shown in FIG. 3, in this embodiment, a decrease section 1 to a decrease section 5 are extracted. The actual measurement value (value detected by the detection unit) of carbon dioxide in the target space in each of the decrease section 1 to the decrease section 5 is a first example of a value related to the actual measurement value of the carbon dioxide concentration in the target space.

As shown in FIGS. 1 and 2, in Step S30, the control unit (50) estimates an outside air concentration for each decrease section. The outside air concentration is an outdoor carbon dioxide concentration.

A procedure of the control unit (50) estimating the outside air concentration will be described with reference to FIG. 4.

Figure 4:
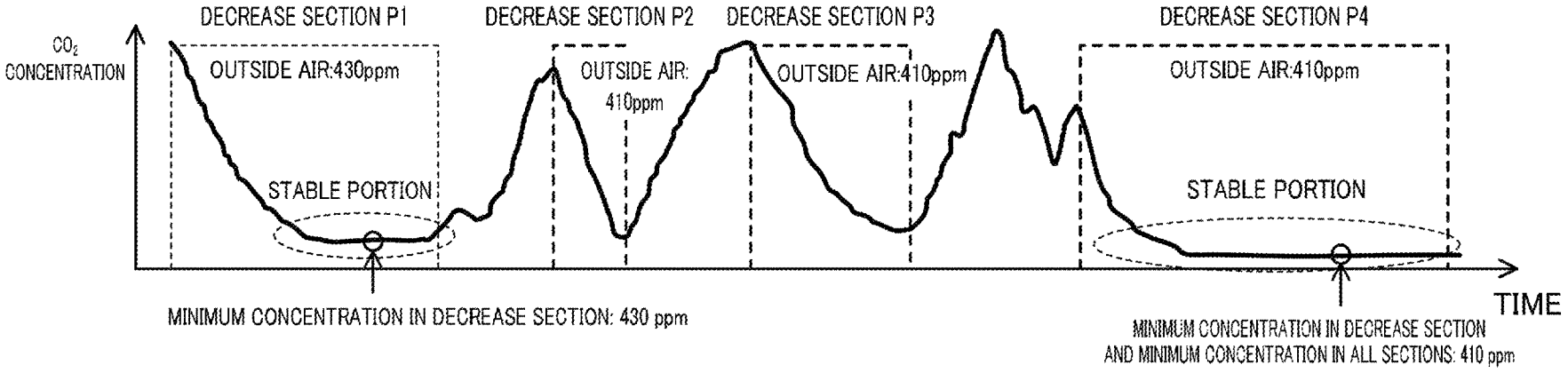
FIG. 4 is a graph showing a procedure of the control unit estimating an outside air concentration.

When the stable portion is present in the decrease section as in a decrease section P1 and a decrease section P4 in FIG. 4, and satisfied is a carbon dioxide concentration condition that the minimum concentration in the stable portion is equal to or less than the minimum concentration in all the sections+100 ppm and equal to or less than a normal concentration when one person is present in a room, the minimum concentration of carbon dioxide in the decrease section is estimated as an outside air concentration. In the decrease section P1 of FIG. 4, 430 ppm is estimated as an outside air concentration, and in the decrease section P4, 410 ppm is estimated as an outside air concentration. The stable portion in the decrease section is a portion in which the carbon dioxide concentration (detection value of the detection unit (30)) in the indoor space has changed only within a predetermined range for a predetermined period.

In a decrease section P2 and a decrease section P3 in FIG. 4, there is no stable portion, and the above concentration condition is not satisfied. When the above concentration condition is not satisfied, the minimum concentration of carbon dioxide in all the sections for which the first data collection processing has been performed is estimated as an outside air concentration. In the decrease section P2 and the decrease section P3, 410 ppm which is the minimum concentration in all the sections is estimated as an outside air concentration.

The outside air concentration is estimated for each of the decrease section 1 to the decrease section 5 shown in FIG. 3 in the same procedure as that when an outside air concentration is estimated for each of the decrease section P1 to the decrease section P4 as described above.

As shown in FIGS. 1 to 3, in Step S40, the control unit (50) estimates, for each of the decrease section 1 to the decrease section 5, a practically possible candidate ventilation amount Q of the target space and the range of the number of remaining people N in the target space at the end of the decrease section.

Range of Candidate Ventilation Amount

The range of the candidate ventilation amount Q is estimated from a designed ventilation amount (design $qm^3/h$) of the target space set in advance. In this embodiment, the range of the candidate ventilation amount Q is estimated at a value within a range indicated by Expression 1 below.

$$1 \leq Q \leq 2 \cdot \text{Design } q \qquad \text{Expression 1}$$

When the designed ventilation amount of the target space is unknown, a reference ventilation amount calculated in consideration of the purpose of use of a building in which the target space is provided, the floor area of the target space, and the like is used instead of the designed ventilation amount.

The interval of the candidate ventilation amount Q is set to a smaller one of design $q/10\ m^3/h$ or $5\ m^3/h$.

The candidate ventilation amount Q is estimated at a value which ranges within the range estimated by Expression 1 and which is selected at the above interval. Accordingly, a plurality of candidate ventilation amounts Q are estimated.

Range of Number of Remaining People

The range of the number of remaining people N is estimated from the carbon dioxide concentration at the start point of the decrease section and the designed ventilation amount. A procedure of estimating the number of remaining people N will be described.

As shown in Expression 2 below, a carbon dioxide generation amount M in the target space at the start point of the decrease section is calculated from the carbon dioxide concentration Cpppm in the target space at the start point of the decrease section and the designed ventilation amount (design $qm^3/h$). Co indicates the outside air concentration estimated in Step S30.

$$\text{Generation Amount } M = \text{Design } q \cdot (Cp - Co) \qquad \text{Expression 2}$$

A possible maximum value Np of the number of occupants in the indoor space at the start point of the decrease section is calculated from a predetermined expression indicating a correlation between human respiration (amount of carbon dioxide discharged) and the carbon dioxide generation amount M, and the range of the number of remaining people N is estimated as in Expression 3 below.

$$0 \leq N \leq Np - 1 \quad \text{Expression 3}$$

For example, when the possible maximum value Np of the number of occupants in the indoor space at the start point of the decrease section is calculated as 10, the number of remaining people N in the indoor space is estimated less than the number of occupants Np at the start point of the decrease section, and thus the number of remaining people N is estimated as an integer of 0 or more and 9 or less (N=0, 1, 2, . . . , 9). Accordingly, a plurality of the numbers of remaining people N are estimated. The combination of the candidate ventilation amount Q and the number of remaining people N is a first example of the condition.

As shown in FIGS. 1 and 2, in Step S50, the control unit (50) creates, for each of the decrease section 1 to the decrease section 5, plural pieces of concentration decrease data from the carbon dioxide concentration at the start point of the decrease section by actual measurement for all combinations of the plurality of candidate ventilation amounts Q and the plurality of the numbers of remaining people N estimated in Step S40. Each of the plural pieces of concentration decrease data is a calculation result that is an output of simulation of a temporal change in decrease in the carbon dioxide concentration in the target space at the candidate ventilation amount Q and the number of remaining people N. The plural pieces of concentration decrease data are created by changing the conditions for the candidate ventilation amount Q and the number of remaining people N within the ranges determined above. The simulation for outputting the concentration decrease data is performed using the information indicating the volume of the target space, the information indicating the candidate ventilation amount Q, the information indicating the number of remaining people N, and the like. The concentration decrease data is created for each decrease section. For example, for the decrease section 2 (see FIG. 3), concentration decrease data A to concentration decrease data D are created as indicated by a dotted line in FIG. 5. The concentration decrease data A to the concentration decrease data D are a first example of a plurality of calculation results related to the carbon dioxide concentration in the target space that was calculated with the condition changed.

Figures 5, 6:
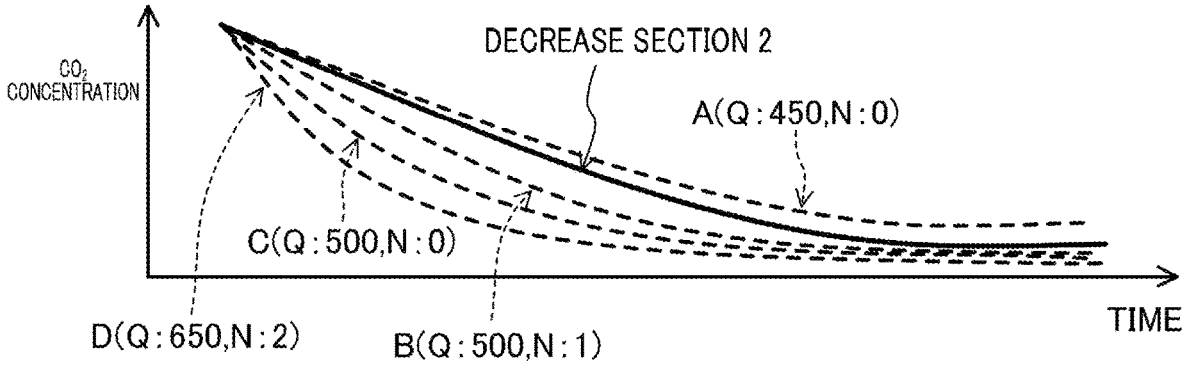
FIG. 5 is a graph showing an actual measurement value of a temporal change and a calculation result of a temporal change with the condition changed.
FIG. 6 is a table showing a ventilation amount, the number of remaining people, and an error in each decrease section.

The control unit (50) determines, for each of the decrease section 1 to the decrease section 5, a combination of Q and N to be employed for concentration decrease data (calculation result under predetermined conditions) having the smallest mean square error, which is an error from the actual measurement value obtained by the detection unit (30), among the plural pieces of concentration decrease data. For example, in the decrease section 2 (see FIG. 3), the combination of Q and N to be employed for the concentration decrease data having the smallest mean square error with respect to the actual measurement value indicated by a solid line in FIG. 5 is the combination of Q (=450) and N (=0) employed for the concentration decrease data A among the concentration decrease data A to the concentration decrease data D.

The same processing as that for the decrease section 2 is performed for each of the decrease section 1 and the decrease section 3 to the decrease section 5 (see FIG. 3), and the combination of Q and N to be employed for the concentration decrease data having the smallest mean square error is determined. As a result, as shown in FIG. 6, the combination of Q and N is determined for each of the decrease section 1 to the decrease section 5.

As shown in FIGS. 1 to 3 and 6, in Step S60, the control unit (50) estimates the ventilation amount in each of the decrease section 1 to the decrease section 5 as the candidate ventilation amount Q determined in Step S50. For each of the decrease section 1 to the decrease section 5, the control unit (50) outputs, as an estimated value of the ventilation amount of the target space, a weighted average Wm which is the average of the estimated ventilation amount values Q weighted by an error between the above actual measurement value and the calculation result under the predetermined conditions. A procedure of calculating the estimated value of the ventilation amount of the target space will be described below.

The weight Wi of each decrease section is calculated as shown in Expression 4 below, where 1 indicates each decrease section. In this embodiment, i indicates 1 (decrease section 1) to 5 (decrease section 5). Ei indicates an error between the actual measurement value and the calculation result (concentration decrease data having the smallest error with respect to the actual measurement value) under the predetermined conditions in each decrease section.

$$Wi = (1/Ei)/\sum(1/Ei) \quad \text{Expression 4}$$

In this embodiment, Σ(1/Ei) is expressed as in Expression 5 below.

$$\sum(1/Ei) = 1/7.642 + 1/11.519 + \ldots + 1/12.945 = 1.573 \quad \text{Expression 5}$$

As shown in Expression 6 below, the weighted average Wm is calculated. Qi indicates the estimated value of the ventilation amount in each decrease section.

$$Wm = \sum(Qi \times Wi) \quad \text{Expression 6}$$

In this embodiment, the weighted average Wm is expressed as in Expression 7 below.

Expression 7

$$Wm = 650 \times (1/7.642)/1.573 + \ldots + 450 \times (1/12.945)/1.573 = 605$$

Advantages of First Embodiment

As described above, the control unit (50) outputs the estimated value of the ventilation amount of the target space from the calculation result corresponding to the actual measurement value among the plurality of calculation results, based on the value related to the actual measurement value of the carbon dioxide concentration in the target space and the plurality of calculation results related to the carbon dioxide concentration in the target space calculated with the condition changed. The value related to the actual measurement value of the carbon dioxide concentration in the target space indicates the first concentration information (100). The plurality of calculation results related to the carbon dioxide concentration in the target space calculated with the condition changed indicates the plural pieces of concentration decrease data (concentration decrease data A to concentration decrease data D) created with the condition changed for the candidate ventilation amount Q and the number of remaining people N in Step S50. The calculation result corresponding to the actual measurement value among the plurality of calculation results indicates the calculation result closest to the value related to the actual measurement value among the plurality of calculation results. Thus, the ventilation amount of the target space can be estimated using the concentration decrease data having the smallest error with respect to the actual measurement value among the plural pieces of concentration decrease data, and thus, the ventilation amount of the target space can be estimated with favorable accuracy. Further, the control unit (50) outputs the estimated value of the ventilation amount of the target space from the calculation result closest to the actual measurement value based on the volume of the target space, the actual measurement value of the temporal change in the carbon dioxide concentration in the target space, and the calculation result of the temporal change in the carbon dioxide concentration in the target space with the condition changed. The volume of the target space is used in Step S50 when the control unit (50) performs the simulation for outputting the concentration decrease data. The calculation result of the temporal change in the carbon dioxide concentration in the target space with the condition changed indicates the plural pieces of concentration decrease data (concentration decrease data A to concentration decrease data D) created with the condition changed for the candidate ventilation amount Q and the number of remaining people N in Step S50. Thus, the ventilation amount of the target space can be estimated using the concentration decrease data having the smallest error with respect to the actual measurement value among the plural pieces of concentration decrease data, and thus, the ventilation amount of the target space can be estimated with favorable accuracy. In addition, when the ventilation amount of the target space is estimated, it is possible to reduce influence of disturbance such as opening of a window or a door. Further, the ventilation amount of the target space can be estimated without using additional information, such as ON/OFF of a light in the target space, for estimating the number of occupants.

Second Embodiment

A second embodiment of the configuration for estimating the ventilation amount of the target space which is the indoor space will be described. In the second embodiment, the ventilation amount of the target space is also estimated using the ventilation amount estimation device (1) shown in FIG. 1.

Operation of Control Unit of Second Embodiment

Operation of the control unit (50) of the second embodiment will be described.

Figure 7:
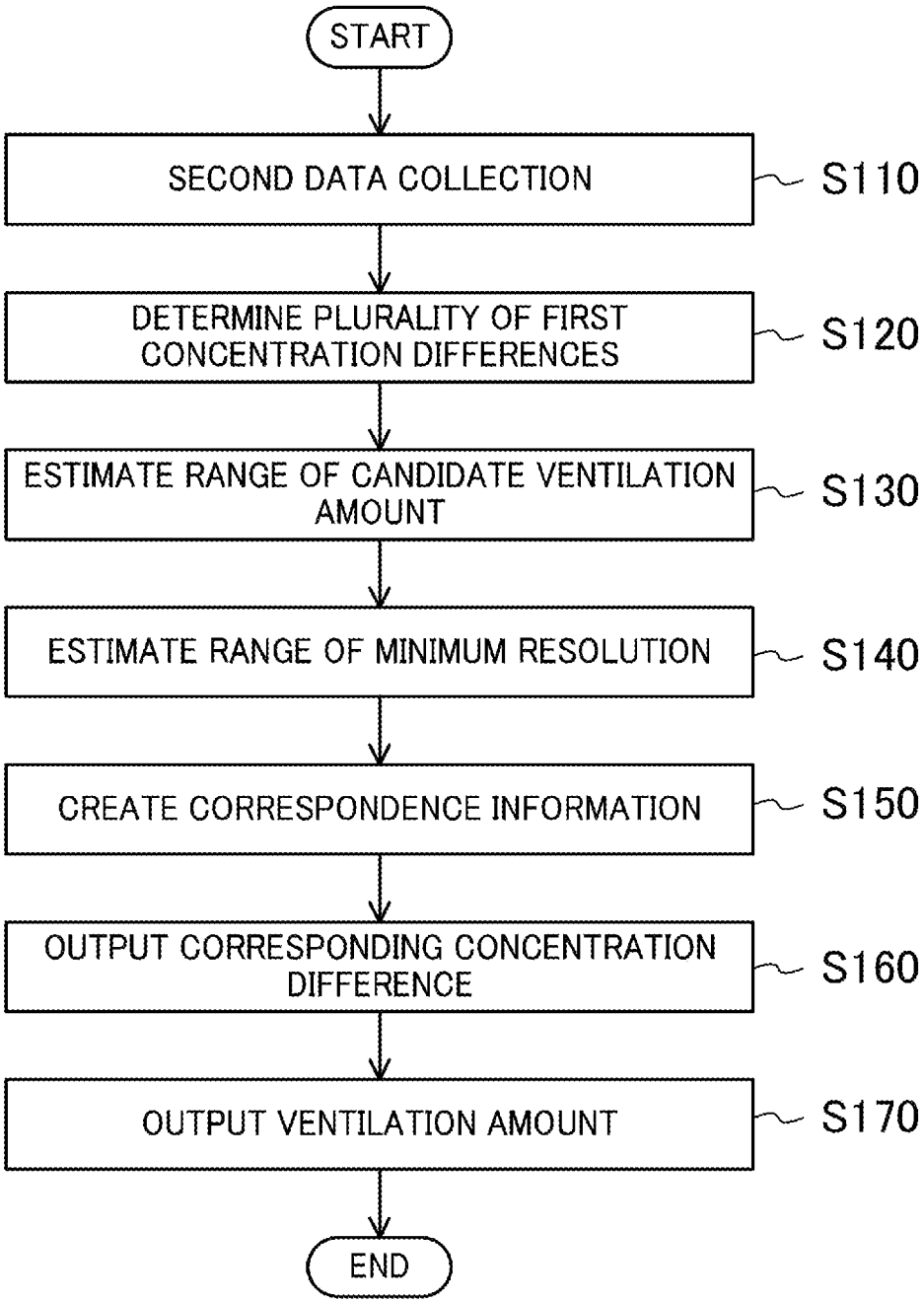
FIG. 7 is a flowchart showing operation of a control unit of a second embodiment.
Figure 8:
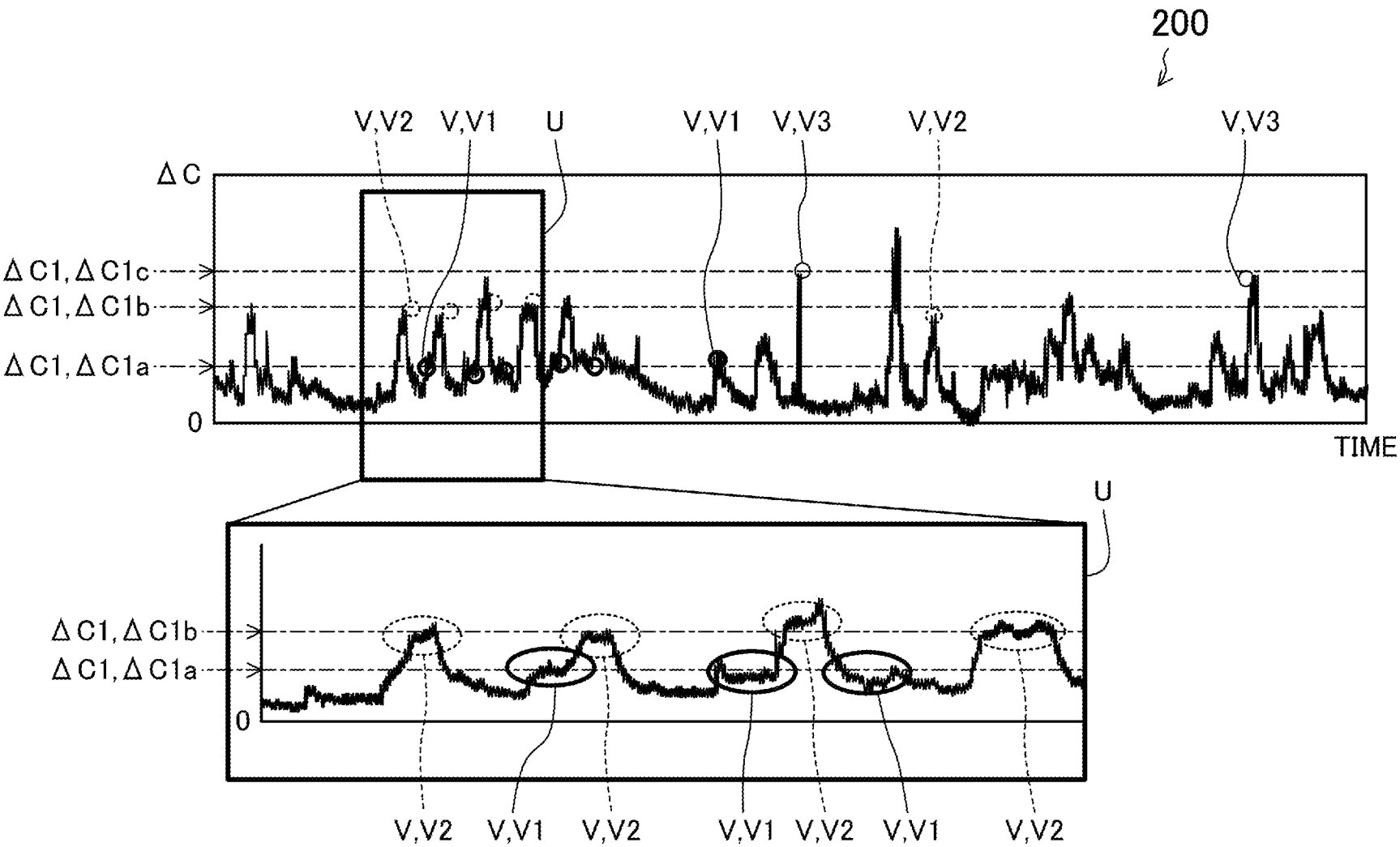
FIG. 8 is a graph showing second concentration information.

As shown in FIGS. 1 and 7, in Step S110, the control unit (50) performs second data collection processing. The second data collection processing is processing of the control unit (50) collecting, for a predetermined period (e.g., one week), the actual measurement value of the carbon dioxide concentration detected in the target space by the detection unit (30) and acquiring second concentration information (200) using the collected actual measurement value of the carbon dioxide concentration. As shown in FIG. 8, the second concentration information (200) indicates a concentration difference ΔC (ppm) between the actual measurement value of the carbon dioxide concentration in the target space, which is output over time, and the outdoor carbon dioxide concentration. The concentration difference ΔC specifically indicates an absolute difference between the actual measurement value of the carbon dioxide concentration in the target space and the outdoor carbon dioxide concentration. The second concentration information (200) is information on an association between the concentration difference ΔC and the time of detection of the carbon dioxide concentration in the target space.

The actual measurement value of the carbon dioxide concentration in the target space, which is used for calculating the concentration difference ΔC, is detected by, for example, the detection unit (30) (see FIG. 1).

The outdoor carbon dioxide concentration used for calculating the concentration difference ΔC may be an actual measurement value of the outdoor carbon dioxide concentration detected by a sensor provided outdoor and configured to detect the outdoor carbon dioxide concentration.

The outdoor carbon dioxide concentration used for calculating the concentration difference ΔC may be a value calculated by the control unit (50). In this case, for example, the control unit (50) calculates, as an outdoor carbon dioxide concentration, the minimum value of the actual measurement values of the carbon dioxide concentration detected in the target space by the detection unit (30) to obtain the second concentration information (200). The control unit (50) may also calculate the outdoor carbon dioxide concentration by performing processing similar to that in Step S30 (see FIGS. 2 and 4).

In Step S120, the control unit (50) determines a plurality of first concentration differences ΔC1 based on the second concentration information (200). The first concentration difference ΔC1 indicates a value based on the concentration difference ΔC when the concentration difference ΔC stably transitions among the concentration differences ΔC indicated by the second concentration information (200). The stable transition of the concentration difference ΔC indicates that, for example, a difference between the maximum and minimum concentration differences ΔC is a value within a predetermined range during a predetermined period. The value based on the concentration difference ΔC when the concentration difference ΔC stably transitions indicates, for example, the mode value of the concentration difference ΔC when the concentration difference ΔC stably transitions.

One example of a procedure of the control unit (50) determining the plurality of first concentration differences ΔC1 will be specifically described with reference to FIG. 8. In FIG. 8, a lower graph of the second concentration information (200) shows an enlarged region (U) of the second concentration information (200).

As shown in FIG. 8, the control unit (50) extracts a plurality of clusters (V) in which the concentration difference ΔC stably transitions from the frequency distribution of the concentration difference ΔC of the second concentration information (200) by performing processing such as cluster analysis of dividing the concentration differences ΔC of the second concentration information (200) output over time by valleys, for example. The cluster (V) indicates a stationary point at which the concentration difference ΔC is substantially constant in the second concentration information (200).

In the second embodiment, a cluster (V1), a cluster (V2), and a cluster (V3) are extracted. The control unit (50) outputs, as the first concentration difference ΔC1, the mode value of the concentration difference ΔC in the cluster (V) for each of the plurality of clusters (V). In the second embodiment, ΔC1a is the mode value for the cluster (V1), and thus a first concentration difference ΔC1a is output. ΔC1b is the mode value for the cluster (V2), and thus a first concentration difference ΔC1b is output. ΔC1c is the mode value for the cluster (V3), and thus a first concentration difference ΔC1c is output. As a result, the plurality of first density differences ΔC1 (first concentration difference ΔC1a, first concentration difference ΔC1b, and first concentration difference ΔC1c) is determined.

Figure 9:
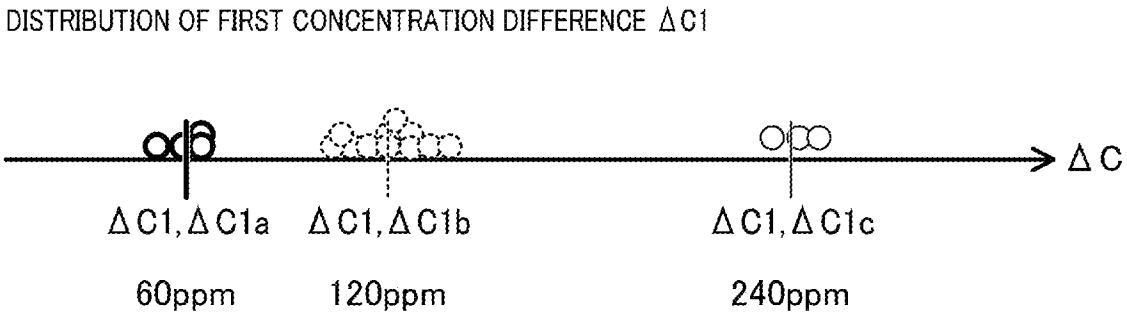
FIG. 9 is a graph showing the distribution of a first concentration difference.

As shown in FIG. 9, in the second embodiment, the first concentration difference ΔC1a to the first concentration difference ΔC1c are distributed so as to increase in the order of the first concentration difference ΔC1a, the first concentration difference ΔC1b, and the first concentration difference ΔC1c. In the second embodiment, the first concentration difference ΔC1a is 60 ppm, the first concentration difference ΔC1b is 120 ppm, and the first concentration difference ΔC1c is 240 ppm.

In Step S130, the control unit (50) estimates the range of a practically possible candidate ventilation amount R of the target space. The range of the candidate ventilation amount R is estimated from the designed ventilation amount (design $qm^3/h$) of the target space set in advance. In this embodiment, the range of the candidate ventilation amount R is estimated at a value within a range indicated by Expression 8 below.

$$0.5 \cdot \text{Design } q \leq R \leq 2 \cdot \text{Design } q \qquad \text{Expression 8}$$

When the designed ventilation amount of the target space is unknown, a reference ventilation amount calculated in consideration of the purpose of use of a building in which the target space is provided, the floor area of the target space, and the like is used instead of the designed ventilation amount. The interval of the candidate ventilation amount R is set to a smaller one of design q/10 $m^3/h$ or 5 $m^3/h$. The candidate ventilation amount R is estimated at a value selected at the above intervals from values within the range estimated by Expression 8. Thus, a plurality of candidate ventilation amounts R is estimated.

In Step S140, possible minimum value ΔC min and maximum value ΔC max of the difference between the carbon dioxide concentration in the target space and the outdoor carbon dioxide concentration when one person is present in the target space are calculated. The minimum value ΔC min is determined from Expression 9 below. A value k is the amount of carbon dioxide generated from one person, which is determined in advance.

$$\Delta C\text{min} = k \cdot 1/(2 \cdot \text{Design } q) \qquad \text{Expression 9}$$

The maximum value ΔC max is determined by Expression 10 below.

$$\Delta C\text{max} = k \cdot 1/(0.5 \cdot \text{Design } q) \qquad \text{Expression 10}$$

As shown in FIGS. 7 and 10, in Step S150, the control unit (50) creates correspondence information (W). The correspondence information (W) is information on an association between the plurality of candidate ventilation amounts R and a plurality of second concentration differences ΔC2. Each of the plurality of second concentration differences ΔC2 indicates a difference, which is output by calculation of the control unit (50), between the carbon dioxide concentration in the target space and the outdoor carbon dioxide concentration.

Each of the plurality of second concentration differences ΔC2 is the minimum resolution, i.e., the difference between the carbon dioxide concentration in the target space and the outdoor carbon dioxide concentration when one person is present in the target space.

Each of the plurality of second concentration differences ΔC2 is determined by Expression 11 below.

$$\Delta C2 = k \cdot 1/R \qquad \text{Expression 11}$$

The plurality of second concentration differences ΔC2 each correspond to the plurality of candidate ventilation amounts R. In the correspondence information (W) shown in FIG. 10, the second concentration difference ΔC2 and the candidate ventilation amount R arranged next to each other correspond to each other. Each of the plurality of second concentration differences ΔC2 is determined by inputting a value of the corresponding candidate ventilation amount R into Expression 11.

The second concentration difference ΔC2 included in the correspondence information (W) is limited to a value within a range of ΔC min or more and ΔC max or less. Thus, in the correspondence information (W), the value of the candidate ventilation amount R corresponding to the second concentration difference ΔC2 is also limited. In the second embodiment, in the correspondence information (W), the second concentration difference ΔC2 is limited to a value within a range of 20 ppm or more and 80 ppm or less, and the candidate ventilation amount R is limited to a value within a range of 50 $m^3/h$ or more and 200 $m^3/h$ or less. This can reduce a computational burden on the control unit (50) when the ventilation amount of the target space is estimated.

As shown in Expression 11, when the second concentration difference ΔC2 is calculated, the carbon dioxide generation amount k of one person is used. Since the carbon dioxide generation amount k of one person is taken into consideration, the second concentration difference ΔC2 indicates the difference between the carbon dioxide concentration in the target space and the outdoor carbon dioxide concentration, which is obtained in consideration of the carbon dioxide generation amount of one person.

Figure 11:
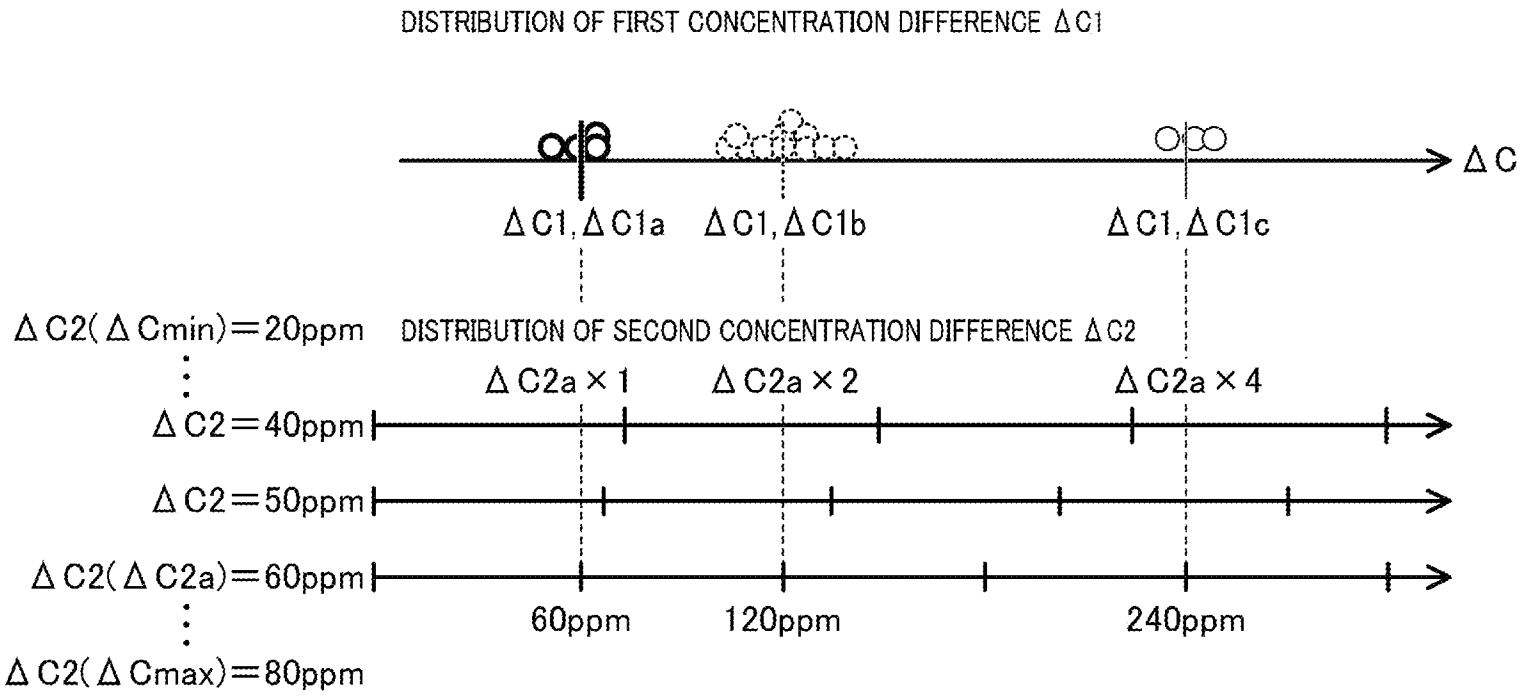
FIG. 11 is a graph showing a relationship between the distribution of the first concentration difference and a second concentration difference.

As shown in FIGS. 7 and 11, in Step S160, the control unit (50) calculates a discrete resolution for each of the plurality of second concentration differences ΔC2 based on the second concentration difference ΔC2 which is the minimum resolution. The discrete resolution is a set of values (ΔC2× J (J is a natural number (1, 2, 3, . . . )) obtained by multiplying the second concentration difference ΔC2 by the natural number. The control unit (50) calculates, for each of the plurality of second concentration differences ΔC2, a squared error between the discrete resolution and the plurality of first concentration differences ΔC1 (first concentration difference ΔC1a to first concentration difference ΔC1c). The control unit (50) outputs, as a corresponding concentration difference, the second concentration difference ΔC2 having the smallest squared error among the plurality of second concentration differences ΔC2.

In the second embodiment, the squared error between the discrete resolution (ΔC2a×1=60 ppm, ΔC2a×2=120 ppm, and ΔC2a×4=240 ppm) of the second concentration difference ΔC2a (=60 ppm) among the plurality of second concentration differences ΔC2 and the plurality of first concentration differences ΔC1 (first concentration difference ΔC1a to first concentration difference ΔC1c) (see FIG. 9) is the smallest. As a result, in the second embodiment, the second concentration difference ΔC2 (=60 ppm) is output as a corresponding concentration difference.

As shown in FIGS. 7 and 10, in Step S170, the control unit (50) outputs, as an estimated value of the ventilation amount of the target space, the candidate ventilation amount R corresponding to the corresponding concentration difference in the correspondence information (W). In the second embodiment, the corresponding concentration difference is the second concentration difference ΔC2a (=60 ppm). As a result, in the second embodiment, the candidate ventilation amount R (=140 $m^3$/h) corresponding to the second concentration difference ΔC2a (=60 ppm) in the correspondence information (W) is output as an estimated value of the ventilation amount of the target space.

Third Embodiment

In the third embodiment, the control unit (50) estimates the ventilation amount under a ventilation condition (natural ventilation, mechanical ventilation, or the like) mainly applied.

Operation of Control Unit of Third Embodiment

Operation of the control unit (50) of the third embodiment will be described.

Figure 12:
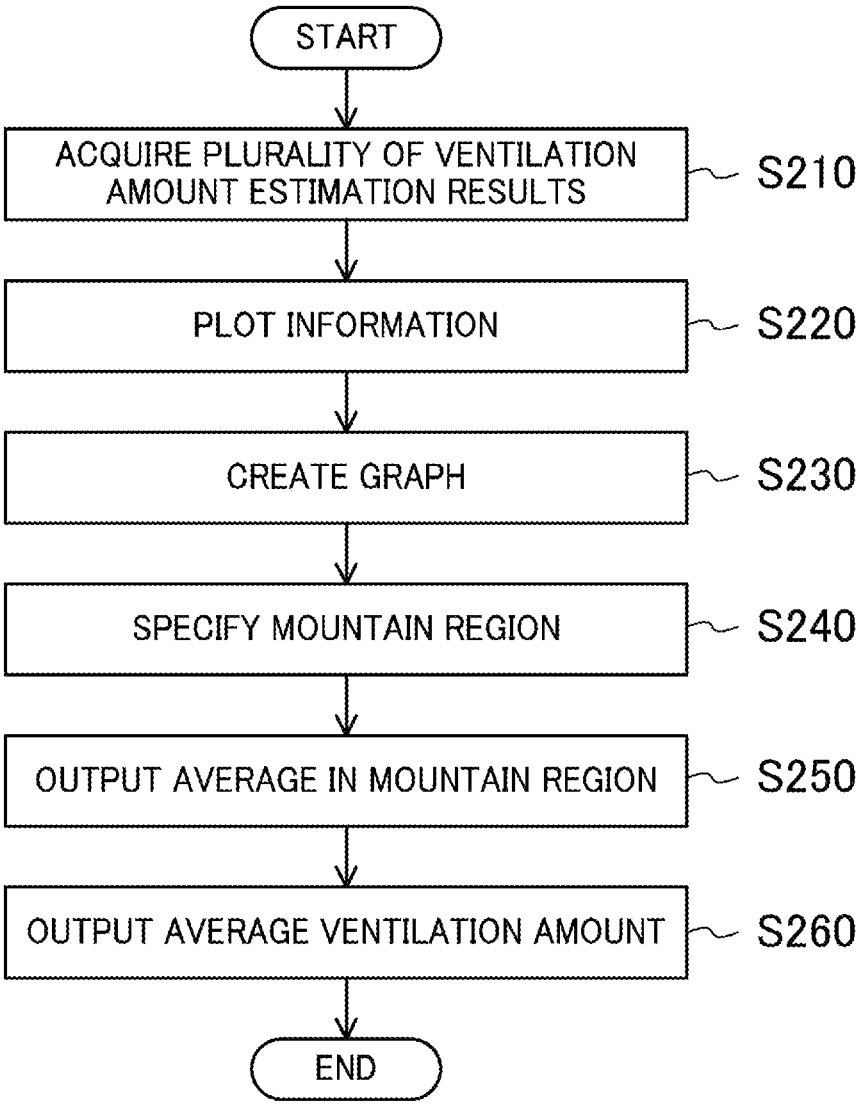
FIG. 12 is a flowchart showing operation of the control unit of the second embodiment.

As shown in FIGS. 1 and 12, in Step S210, the control unit (50) performs first ventilation amount estimation processing multiple times to acquire a plurality of ventilation amount estimation results. The first ventilation amount estimation processing is processing of outputting the estimated value of the ventilation amount of the target space described in the first embodiment above (see FIG. 2). The control unit (50) may perform second ventilation amount estimation processing multiple times to acquire a plurality of ventilation amount estimation results. The second ventilation amount estimation processing is processing of outputting the estimated value of the ventilation amount of the target space described in the second embodiment above (see FIG. 7). The control unit (50) may perform the first ventilation amount estimation processing and the second ventilation amount estimation processing to acquire a plurality of ventilation amount estimation results. The ventilation amount estimation result indicates the estimated value of the ventilation amount of the target space.

In Step S210, the processing performed to acquire the plurality of ventilation amount estimation results is not limited to the first ventilation amount estimation processing and the second ventilation amount estimation processing. In Step S210, when the plurality of ventilation amount estimation results are acquired, processing other than the first ventilation amount estimation processing and the second ventilation amount estimation processing may be performed.

Figure 13:
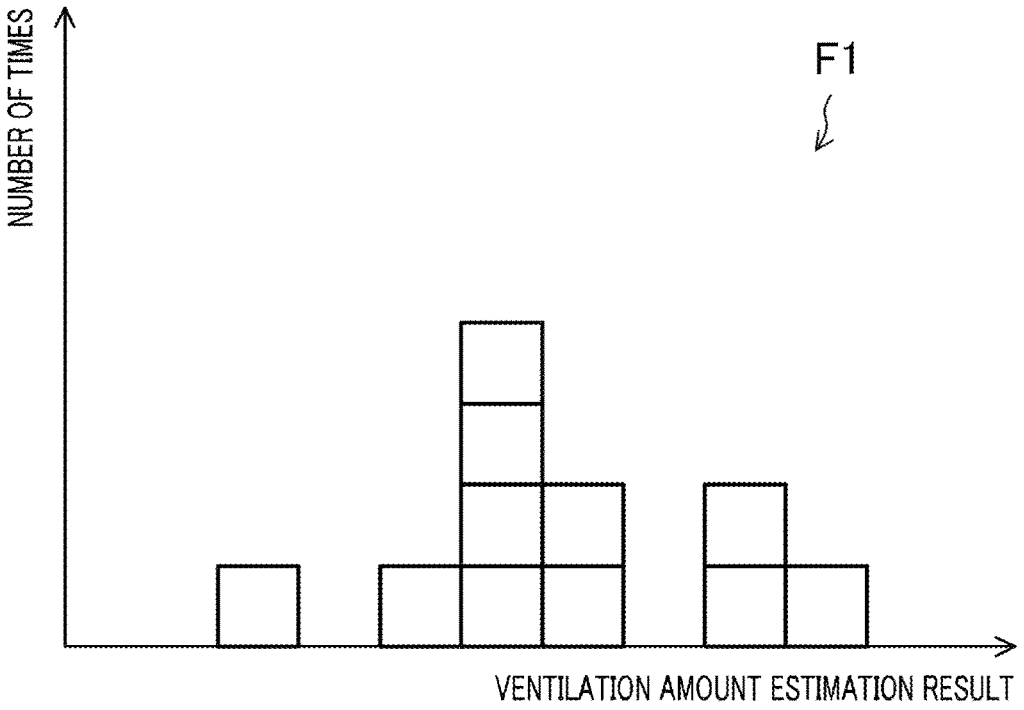
FIG. 13 is a graph showing plot information.

As shown in FIGS. 12 and 13, in Step S220, the control unit (50) creates plot information (F1) from the plurality of ventilation amount estimation results (estimated values of the ventilation amount of the target space). The plot information (F1) is information on an association between the number of times and the ventilation amount estimation result, and is information in which the frequency distribution of the ventilation amount estimation result is plotted. In a coordinate system for the plot information (F1), the vertical axis indicates the number of times, and the horizontal axis indicates the ventilation amount estimation result. The number of times is the number of times (frequency) of execution of the processing of acquiring the ventilation amount estimation result (the number of times=frequency). The number of times may be a value obtained by dividing the frequency by an error (the number of times=frequency/error). The error indicates an error between the ventilation amount estimation result and the actual measurement value of the ventilation amount.

Figure 14:
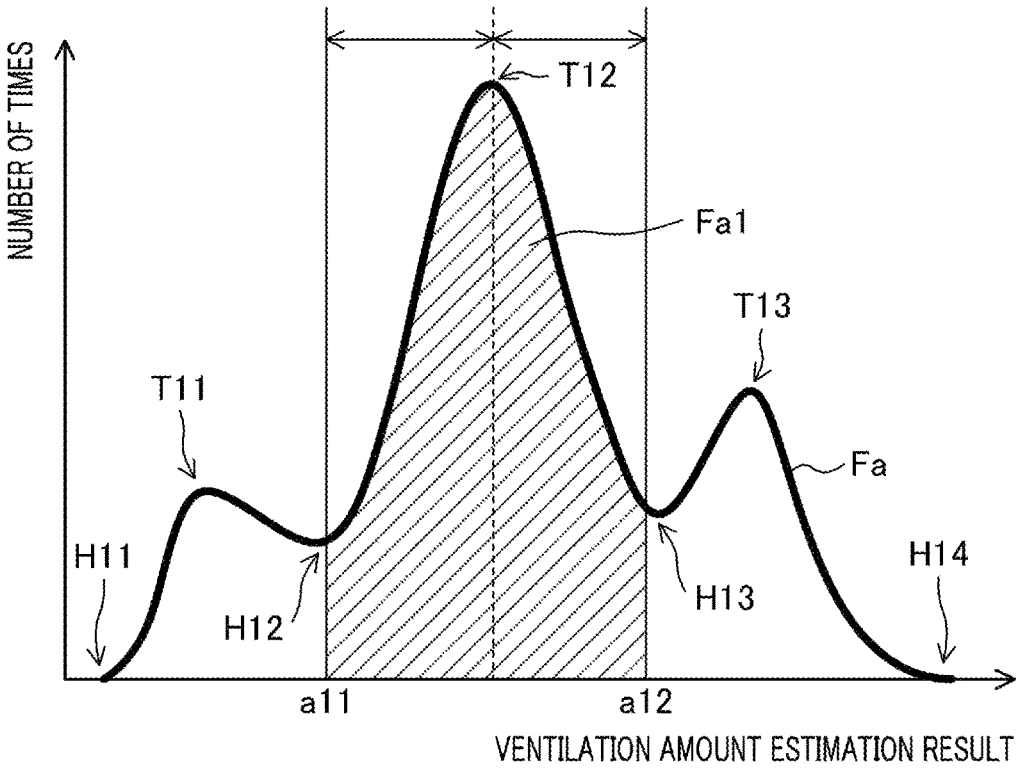
FIG. 14 is a graph showing a first graph.

As shown in FIGS. 12 and 14, in Step S230, the control unit (50) creates a first graph (Fa) obtained by smoothing the plot information (F1). The first graph (Fa) is information on an association between the number of times and the ventilation amount estimation result, and indicates the frequency distribution of the ventilation amount estimation result. In a coordinate system for the first graph (Fa), the vertical axis indicates the number of times, and the horizontal axis indicates the ventilation amount estimation result.

The first graph (Fa) includes a plurality of peaks (T11, T12, T13) and a plurality of bottoms (H11, H12, H13, H14). In the first graph (Fa), any of the plurality of peaks (T11, T12, T13) and any of the plurality of bottoms (H11, H12, H13, H14) are alternately present. The peaks (T11, T12, T13) are points located on a side in an increasing direction of the number of times (positive side on the vertical axis in FIG. 14) among points where the slope of a tangent is zero on the first graph (Fa). The bottoms (H11, H12, H13, H14) are points located on a side in a decreasing direction of the number of times (negative side on the vertical axis in FIG. 14) among the points where the slope of the tangent is zero on the first graph (Fa).

As shown in FIGS. 12 and 14, in Step S240, the control unit (50) specifies a mountain region. The mountain region is a region including the peak of the frequency in the frequency distribution of the ventilation amount estimation result in which the frequency and the ventilation amount estimation result are associated with each other. In other words, the mountain region is a region between a first valley and a second valley when the frequency changes in the order of the first valley, the peak, and the second valley with an increase in the ventilation amount estimation result in the frequency distribution of the ventilation amount estimation result in which the frequency and the ventilation amount estimation result are associated with each other.

In the third embodiment, the first graph (Fa) indicating the frequency distribution of the ventilation amount estimation result includes the plurality of peaks (T11, T12, T13). In the third embodiment, a mountain region (Fa1) specified by the control unit (50) is a region including the maximum peak (T12) among the plurality of peaks (T11, T12, T13), and is a region between the bottom (H12) and the bottom (H13) on the first graph (Fa).

In Step S250, the control unit (50) outputs the average a of the ventilation amount estimation results in the mountain region (Fa1). The average a of the ventilation amount estimation results in the mountain region (Fa1) is a value obtained by dividing the sum of the products of the number of times and the ventilation amount estimation result corresponding to the number of times in the mountain region (Fa1) by the sum of the number of times in the mountain region (Fa1). In the third embodiment, the average a of the ventilation amount estimation results in the mountain region (Fa1) is a value obtained by dividing an area ß between a ventilation amount estimation result (a11) and a ventilation amount estimation result (a12) on the first graph (Fa) by the sum of the number of times y between the ventilation amount estimation result (all) and the ventilation amount estimation result (a12) on the first graph (Fa) (a=B/y). A ventilation amount estimation result (a21) corresponds to the bottom (H12), and the ventilation amount estimation result (a12) corresponds to the bottom (H13).

In Step S260, the control unit (50) outputs the average a of the ventilation amount estimation results in the mountain region (Fa1), which has been output in Step S250, as an estimated value of the ventilation amount of the target space when processing of ventilating the target space is performed under a specific ventilation condition.

As shown in FIG. 14, since the first graph (Fa) includes the plurality of peaks (T11, T12, T13), a plurality of mountain regions (region from the bottom (H11) to the bottom (H12), region from the bottom (H12) to the bottom (H13), and region from the bottom (H13) to the bottom (H14)) is specified on the first graph (Fa). Since the corresponding ventilation amount estimation result varies according to a mountain region, it is estimated that the processing of ventilating the target space is performed under mutually different ventilation conditions (natural ventilation, mechanical ventilation, and the like).

In the third embodiment, the average a of the ventilation amount estimation results in the mountain region (Fa1) including the maximum peak (T12) is output. The mountain region (Fa1) includes the maximum peak (T12), which means that the frequency is the highest and indicates that such a ventilation condition is mainly applied when the processing of ventilating the target space is performed. Thus, in the third embodiment, the average a of the ventilation amount estimation results is output as an estimated value of the ventilation amount of the target space when the processing of ventilating the target space is performed under the ventilation condition mainly applied.

Variation of Third Embodiment

Figure 15:
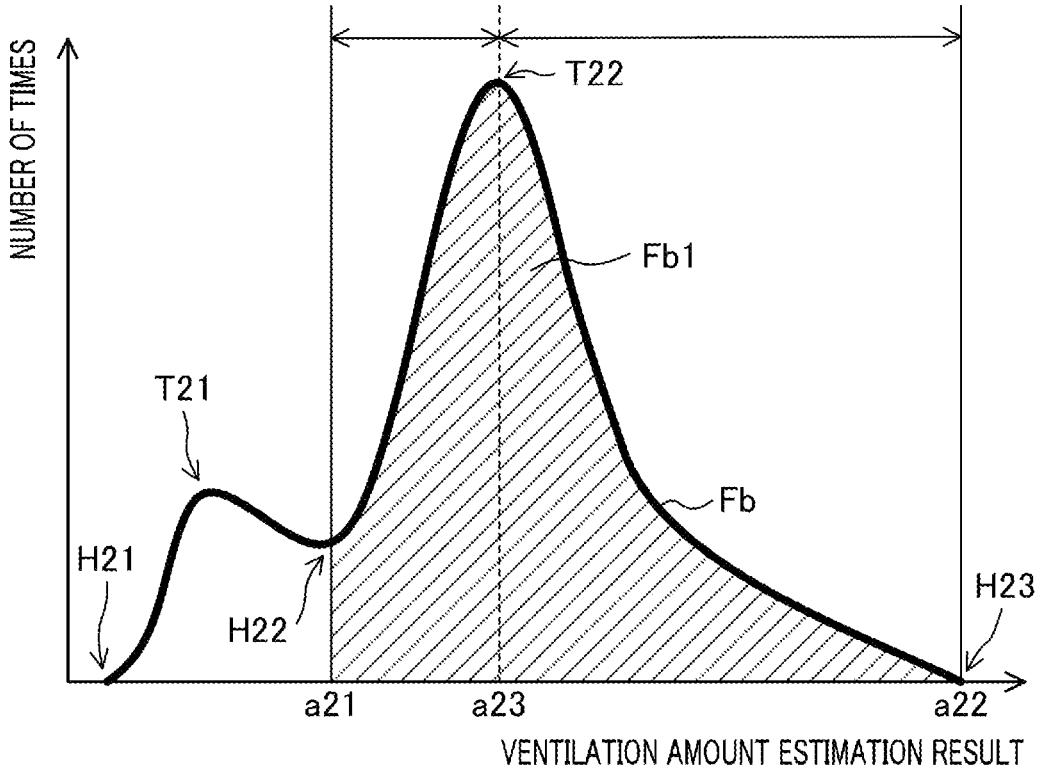
FIG. 15 is a graph showing a second graph.

FIG. 15 shows a second graph (Fb) which is a variation of the first graph (Fa) (see FIG. 14). As shown in FIG. 15, the second graph (Fb) includes a plurality of peaks (T21, T22) and a plurality of bottoms (H21, H22, H23). As shown in FIG. 15, in the variation of the third embodiment, the second graph (Fb) is created in Step S230 (see FIG. 12).

As shown in FIG. 15, in the variation of the third embodiment, in Step S240 (see FIG. 12), the control unit (50) specifies a mountain region (Fb1). The mountain region (Fb1) is a region including a peak at which the corresponding ventilation amount estimation result is the maximum among the plurality of peaks (T21, T22). In the variation of the third embodiment, as shown in the second graph (Fb) of FIG. 15, a ventilation amount estimation result (a23) corresponding to the peak (T22) is greater than a ventilation amount estimation result (a21) corresponding to the peak (T21) among the peaks (T21, T22). As a result, the mountain region (Fb1) is specified as a region including the peak (T22), and is specified as a region between the bottom (H22) and the bottom (H23) on the second graph (Fb).

As shown in FIG. 15, in the variation of the third embodiment, in Step S250 (see FIG. 12), the control unit (50) outputs the average of the ventilation amount estimation results in the mountain region (Fb1). In Step S260 (see FIG. 12), the control unit (50) outputs the average of the ventilation amount estimation results in the mountain region (Fb1) as the estimated value of the ventilation amount of the target space when the processing of ventilating the target space is performed under a specific ventilation condition.

Generally, when mechanical ventilation is performed, ventilation is performed more efficiently than when natural ventilation is, and thus the ventilation amount increases. Thus, when the ventilation amount estimation result increases, it can be estimated that mechanical ventilation is performed. In the variation of the third embodiment, the mountain region (Fb1) is the region including the peak (T22) at which the corresponding ventilation amount estimation result among the plurality of peaks (T21, T22) is the maximum. Thus, in the mountain region (Fb1), the corresponding ventilation amount estimation result is greater than that in a mountain region including the peak (T21), and thus it can be estimated that mechanical ventilation is performed. Thus, in the third embodiment, the average of the ventilation amount estimation results in the mountain region (Fb1) where the ventilation amount estimation result increases is output, and thus the average a of the ventilation amount estimation results is output as an estimated value of the ventilation amount of the target space when the processing of ventilating the target space is performed by mechanical ventilation.

In Steps S210 to S240 (see FIG. 12), when specifying the mountain region (Fa1), the control unit (50) creates the plot information (F1) by plotting the frequency distribution of the ventilation amount estimation result; creates the first graph (Fa) obtained by smoothing the plot information (F1); and specifies the mountain region (Fa1) from the first graph (Fa). However, the present invention is not limited thereto. For example, the control unit (50) may determine the frequency distribution of the plurality of ventilation amount estimation results in numerical values to specify the mountain region (Fa1) without plotting the frequency distribution of the ventilation amount estimation result. The control unit (50) may specify the mountain region (Fa1) by classifying the plurality of ventilation amount estimation results using cluster analysis or the like. The control unit (50) may specify the mountain region (Fa1) using a statistical method such as outlier testing for the plurality of ventilation amount estimation results.

Other Embodiments

While the embodiments and variations thereof have been described above, it will be understood that various changes in form and details may be made without departing from the spirit and scope of the claims. The foregoing embodiments and variations thereof may be combined and replaced with each other without deteriorating the intended functions of the present disclosure.

As described above, the present disclosure is useful for a ventilation amount estimation device, a ventilation amount estimation method, and a program.

The invention claimed is:

1. A ventilation amount estimation device for estimating a ventilation amount of a target space that is an indoor space, comprising:

a control unit including a processor, the control unit being configured to execute a program to acquire a value related to an actual measurement value of a carbon dioxide concentration in the target space, calculate a plurality of calculation results related to the carbon dioxide concentration in the target space, the plurality of calculation results being calculated while varying a condition, select a calculation result corresponding to the actual measurement value from among the plurality of calculation results, and output the calculation result that was selected as an estimated value of the ventilation amount of the target space, the varying the condition including varying a number of people assumed to be remaining in the target space.

2. The ventilation amount estimation device of claim 1, wherein the calculation result corresponding to the actual measurement value of the plurality of calculation results indicates a calculation result closest to the value related to the actual measurement value of the plurality of calculation results.

3. The ventilation amount estimation device of claim 1, wherein the condition includes a combination of a candidate ventilation amount and the number of remaining people in the target space, and the candidate ventilation amount is a possible ventilation amount of the target space.

4. The ventilation amount estimation device of claim 1, wherein the value related to the actual measurement value of the carbon dioxide concentration in the target space indicates an actual measurement value of the carbon dioxide concentration in the target space in a decrease section in which the carbon dioxide concentration in the target space decreases over time.

5. The ventilation amount estimation device of claim 4, wherein the decrease section includes a plurality of decrease sections, and actual measurement values in the plurality of decrease sections are used.

6. The ventilation amount estimation device of claim 5, wherein for each of the plurality of decrease sections, the control unit is configured to output an estimated value of the ventilation amount, and as an estimated value of the ventilation amount of the target space, an average of the estimated value of the ventilation amount weighted by an error between the actual measurement value and the calculation result under a predetermined condition.

7. A ventilation amount estimation device for estimating a ventilation amount of a target space that is an indoor space, comprising:

a control unit including a processor, the control unit being configured to execute a program to acquire a value related to an actual measurement value of a carbon dioxide concentration in the target space, calculate a plurality of calculation results related to the carbon dioxide concentration in the target space, the plurality of calculation results being calculated while varying a condition, select a calculation result corresponding to the actual measurement value from among the plurality of calculation results, and output the calculation result that was selected as an estimated value of the ventilation amount of the target space, the value related to the actual measurement value indicating a plurality of first concentration differences different from each other, each of the plurality of first concentration differences being a difference between the actual measurement value of the carbon dioxide concentration in the target space and an outdoor carbon dioxide concentration, and each of the plurality of calculation results indicating a second concentration difference between the carbon dioxide concentration in the target space and the outdoor carbon dioxide concentration, which is obtained in consideration of a carbon dioxide generation amount of one person.

8. The ventilation amount estimation device of claim 7, wherein each of the plurality of first concentration differences indicates a value based on a concentration difference when the concentration difference stably transitions, of concentration differences between the actual measurement value of the carbon dioxide concentration in the target space, which is output over time, and the outdoor carbon dioxide concentration.

9. The ventilation amount estimation device of claim 7, wherein the condition indicates a candidate ventilation amount, which is a possible ventilation amount of the target space.

10. The ventilation amount estimation device of claim 9, wherein the control unit is configured to output a corresponding concentration difference corresponding to the plurality of first concentration differences of the plurality of second concentration differences, and the candidate ventilation amount corresponding to the corresponding concentration difference as an estimated value of the ventilation amount of the target space.

11. A ventilation amount estimation device for estimating a ventilation amount of a target space that is an indoor space, comprising:

a control unit including a processor, the control unit being configured to execute a program to acquire a value related to an actual measurement value of a carbon dioxide concentration in the target space, calculate a plurality of calculation results related to the carbon dioxide concentration in the target space, the plurality of calculation results being calculated while varying a condition, select a calculation result corresponding to the actual measurement value from among the plurality of calculation results, and output the calculation result that was selected as an estimated value of the ventilation amount of the target space, the control unit being further configured to specify a mountain region including a peak of a frequency in a frequency distribution of a ventilation amount estimation result indicating the estimated value of the ventilation amount of the target space.

12. The ventilation amount estimation device of claim 11, wherein in the frequency distribution, the peak includes a plurality of peaks, and the mountain region includes a maximum peak of the plurality of peaks.

13. The ventilation amount estimation device of claim 11, wherein in the frequency distribution, the peak includes a plurality of peaks, and the mountain region includes a peak of the plurality of peaks at which a corresponding ventilation amount estimation result is maximum.

14. The ventilation amount estimation device of claim 11, wherein the control unit is configured to output an average of the ventilation amount estimation result in the mountain region as an estimated value of the ventilation amount of the target space when processing of ventilating the target space is performed under a specific ventilation condition.

* * * * *